US006806633B2

(12) United States Patent
Murai et al.

(10) Patent No.: US 6,806,633 B2
(45) Date of Patent: Oct. 19, 2004

(54) CATHODE RAY TUBE

(75) Inventors: Ryuichi Murai, Toyonaka (JP); Shinichiro Hatta, Nara (JP); Hiroshi Iwamoto, Osaka (JP); Shigeo Nakatera, Hirakata (JP); Takayuki Yonezawa, Takatuki (JP); Tomohisa Mikami, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 154 days.

(21) Appl. No.: 10/169,236

(22) PCT Filed: Dec. 26, 2000

(86) PCT No.: PCT/JP00/09282

§ 371 (c)(1),
(2), (4) Date: Dec. 10, 2002

(87) PCT Pub. No.: WO01/48783

PCT Pub. Date: Jul. 5, 2001

(65) Prior Publication Data

US 2004/0032196 A1 Feb. 19, 2004

(30) Foreign Application Priority Data

Dec. 27, 1999 (JP) ..... 11-369870
Aug. 31, 2000 (JP) ..... 2000-264067

(51) Int. Cl.[7] ..... H01J 29/06
(52) U.S. Cl. ..... 313/407; 313/479
(58) Field of Search ..... 313/402, 404, 313/406, 407, 479

(56) References Cited

U.S. PATENT DOCUMENTS 5,363,010 A * 11/1994 Van Mensvoort ..... 313/402
6,459,194 B1 * 10/2002 Akita ..... 313/402

FOREIGN PATENT DOCUMENTS

JP 06275205 3/1993
JP 09283041 4/1996

* cited by examiner

*Primary Examiner*—Ashok Patel

(57) ABSTRACT

An inner magnetic shield is provided that reduces misland-ing lengths due to electron beam distortion caused by external magnetic fields such as terrestrial magnetism, thereby reducing the occurrence of drifted or uneven color throughout an entire display screen. The inner magnetic shield is of a tube with a plurality of side surfaces, and is provided with at least one skirt (37) that extends to the vicinity of a spanning member (41) at a location where the inner magnetic shield is not in contact with a holding member (42). The skirt (37) is magnetically coupled with the spanning member (42).

16 Claims, 8 Drawing Sheets

CATHODE RAY TUBE

TECHNICAL FIELD

The present invention relates to a cathode ray tube, and in particular to the shapes and form of a mask frame and an inner magnetic shield being joined together, designed to reduce negative effects caused by terrestrial magnetism.

BACKGROUND ART

FIG. 7 shows a conventional cathode ray tube (hereinafter referred to as a CRT) used in televisions and personal computers and the like. With a CRT such as the one indicated in this drawing, an image on the screen is produced when an electron beam 60 emitted from an electron gun is horizontally and vertically deflected by deflection coils 62 and then is scanned onto the entire display screen. During this process, if an external magnetic field, such as a geomagnetic field, is applied from a direction that is orthogonal to the direction in which the electron beam 60 is traveling, then the beam will become distorted in a manner such as that indicated by 61 (somewhat exaggerated in the drawing). This will result in mislandings of the beam, as it will fail to light the phosphor 64 on the panel 63 in the proper location. As a countermeasure to this, it is common practice to install into the interior of the CRT (in this case, the interior of the funnel section) an inner magnetic shield 65 that surrounds the scanning path of the electron beam.

However, it is impossible to entirely shield out an external magnetic field. Therefore, the actual role played by the inner magnetic shield 65 is that of (a) blocking out a certain amount of the external magnetic field, (b) changing the direction of the magnetic flux so that the electron beam is not affected, and (c) correcting the electron beam when it is affected by the magnetic line of force.

With a few exceptions, terrestrial magnetism is almost always the source of an external magnetic field. This terrestrial magnetism is broken down into a horizontal component (a vector component that is horizontal with the screen) and a vertical component (a vector component that is vertical to the screen). Of these two, it is well known that the vertical component does not pose a problem to the functioning of the CRT. This is due to the fact that the vertical component affects electron beam landing in a uniform way across almost the entire screen, and this phenomenon can easily be counteracted by using a correcting lens to ensure the proper formation of the phosphor surface so that it will compensate for the presence of the vertical component.

On the other hand, as shown in FIG. 8, the horizontal component 70 of terrestrial magnetism is more complicated in that its direction can change depending on its directional position relative to the CRT. Generally, this horizontal component 70 can be broken down into two directions: the CRT tube axial direction 71 and the CRT lateral direction 72.

Accordingly, when one considers a shield against terrestrial magnetism, one must ultimately consider the characteristics of a lateral magnetic field and a tube axial magnetic field, both of these forces being subcomponents of the horizontal component of terrestrial magnetism.

By measuring the amount of change that occurs in the phosphor surface beam landing when an external magnetic field equal to or more powerful than terrestrial magnetism is applied, it is possible to assess the various properties of the CRT. Points to be measured can be, among those shown in FIG. 9, the four corner sections of the screen and the upper and lower central sections of the length of the screen (hereinafter referred to as the NS sections), for example. It is particularly important that the following properties be noted: (1) The properties of the corner sections when a lateral magnetic field is applied (hereinafter referred to as "lateral corner" properties). (2) The properties of the NS sections when a tube axial magnetic field is applied (hereinafter referred to as the "tube axial NS" properties).

FIG. 10 shows the shape of the inner magnetic shield 65. As shown in FIG. 10, the inner magnetic shield 65 is a pyramid including two long sides 71 opposite to each other and two short sides 72 opposite to each other, where an opening 73 is formed at the top.

Each bottom of these sides is outwardly bent to form a bending edge, and in recent shadow masks to which tension is applied, the inner magnetic shield 65 is attached to the mask frame by fixing the bending edges to the mask frame.

As indicated in FIG. 11, the mask frame is composed of a pair of spanning members 81 (L-shaped in a sectional view) and a pair of U-shaped holding members 82. The pair of U-shaped holding members 82 are arranged opposite to each other. The pair of U-shaped holding members 82 are welded and fixed at two pairs of opposite ends of the pair of spanning members 81. A plurality of tensed wires are spanned between the pair of spanning members 81, the plurality of wires forming a shadow mask Ma. The plurality of wires are spanned at certain positions of the holding members 82 which are determined to hold the tension of the shadow mask Ma and to increase the strength of the frame in the direction of tension.

In recent years CRTs with larger screens and flat face plates have become the norm. In the case of CRTs with flat face plates in particular, the above-mentioned method of applying tension to a shadow mask is commonly used.

Conventional inner magnetic shields of CRTs that incorporate this method have tended to produce a dramatically higher amount or mislandings due to terrestrial magnetism. It is believed that this is because the magnetic properties of the shadow mask extremely change when it is placed under tension (Murai et al., SID2000DIGEST, pp582–585). For example, a conventional 25-inch CRT that has a lateral corner property of approximately 10 $\mu$m and a tube axial NS property of approximately 10 $\mu$m would degrade to have a lateral corner property of 15 $\mu$m and a tube axial NS property of 30 $\mu$m when tension is applied to the shadow mask.

Efforts have been made to improve the capabilities of inner magnetic shields constructed as in FIG. 10. For instance, the overall design includes a "V"-shaped section 74 that is cut out of the aforementioned short sides 72. The depth and width of the cuts have been optimized, but the amount of change in beam landing due to external magnetic fields equivalent to terrestrial magnetism have only been improved to:

(lateral corner property, tube axial NS property) (21 $\mu$m, 23 $\mu$m).

Additionally, the rates of change for the lateral corner properties and the tube axial NS properties ate roughly the same, with their measurements being in an inverse trade-off relationship, making it impossible to improve both properties at the same time.

DISCLOSURE OF THE INVENTION

An object of the present invention is to provide an inner magnetic shield that will solve the above problems and decrease the occurrence of drifted or uneven color throughout an entire display screen by decreasing the amount of mislandings caused by distorted electron beams occurring as a result of external magnetic fields such as terrestrial magnetism.

The present invention is a CRT designed to solve the above problems by being provided with an inner magnetic shield, a mask frame, a shadow mask that is affixed to the mask frame, and a face plate in which the mask frame and shadow mask are installed. The mask frame is made up of a pair of attachment members to which the shadow mask is attached, and a pair of positioning members that are joined with the attachment members to keep them in a predetermined position. The inner magnetic shield is of an outwardly square tube shape with a plurality or side surfaces to which at least one skirt is provided that extends, at a location where the inner magnetic shield is not in contact with either of the positioning members, to the vicinity of an attachment member. It is at this location that the skirt is magnetically coupled with the attachment member.

The present invention can also be a CRT designed to solve the above problems by being provided with an inner magnetic shield, a mask frame, a shadow mask that is affixed to the mask frame, and a face plate in which the mask frame and shadow mask are installed. In this case, the mask frame is made up of a pair of spanning members to which the shadow mask is attached in a high tension, and a pair of holding members that are joined with the spanning members to keep them in their proper position with the proper amount of tension place on the shadow mask. The inner magnetic shield is of an outwardly square tube shape with a plurality of side surfaces to which at least one skirt is provided-that extends, at a location where the inner magnetic shield is not in contact with either of the positioning members, to the vicinity of a spanning member. It is at this location that the skirt is magnetically coupled with the spanning member.

With this arrangement, the amount of mislandings caused by distorted electron beams occurring as a result of external magnetic fields such as terrestrial magnetism is lessened and the above-mentioned lateral corner properties and tube axial NS properties are improved. As a result, it is possible to decrease the amount of drifted and uneven color that occurs across the entire display screen.

Once such an arrangement is provided, it is desirable that the above-mentioned skirt be designed so that its length as it runs in the direction of the length of the spanning members is set so that any magnetic flux produced from an external magnetic field flows from the inner magnetic shield toward the mask frame.

In order that the inner magnetic shield can be mounted to the top of the holding members, the inner magnetic shield should be provided with a plurality of mounting surface members at the extreme ends of its above-mentioned side surfaces that extend toward the mask frame. And at locations where these mounting surface members are above the spanning members, it is possible for one or more skirts to be formed by being extended from the edge of the mounting surface members so that they reach the vicinity of a spanning member.

With this arrangement, it is desirable that the skirt that reaches the vicinity of the spanning member be designed so that its length as it runs in the direction of the length of the spanning member is ¼ to ⅓ that of the distance between the holding members. This will result in a decrease in electron beam mislandings.

There is another possible design for this invention. As in the above descriptions, the present invention can be a CRT designed to solve the above problems by being provided with an inner magnetic shield, a mask frame, a shadow mask that is affixed to the mask frame, and a face plate in which the mask frame and shadow mask are installed. The mask frame is made up of a pair of attachment, members to which the shadow mask is attached, and a pair of positioning members that are joined with the attachment members to keep them in a predetermined position. The inner magnetic shield is of an outwardly rectangular tube shape with a plurality of side surfaces to which at least one primary skirt is provided that extends, at a location where the inner magnetic shield is not in contact with either of the positioning members, to the vicinity of an attachment member. It is at this juncture that this design varies from those described above in that it also includes at least one secondary skirt that extends down over the outer surface of the mask frame to cover an attachment member at the area where that attachment member is joined to a positioning member. The length of this secondary skirt as it runs in the direction of the length of the attachment members should be 1 to 2 times that of the area where the attachment member is joined to the positioning member. After these various arrangements have been made, the primary skirt and the secondary skirt are magnetically coupled with the attachment member.

The present invention can also be a CRT designed to solve the earlier-mentioned problems by being provided with an inner magnetic shield, a mask frame, a shadow mask that is affixed to the mask frame, and a face plate in which the mask frame and shadow mask are installed. The mask frame is made up of a pair of spanning members to which the shadow mask is attached in a state of tension, and a pair of holding members that are joined with the spanning members to keep them in their proper position with the proper amount of tension place on the shadow mask. The inner magnetic shield is of an outwardly rectangular tube shape with a plurality of side surfaces to which at least one primary skirt is provided that extends, at a location where the inner magnetic shield is not in contact with either of the positioning members, to the vicinity of a spanning member. Similar to that described in the above paragraph, this design includes at least one secondary skirt that extends down over the outer surface of the mask frame to cover a spanning member at the area where that spanning member is joined to a holding member. The length of this secondary skirt as it runs in the direction of the length of the spanning members should be 1 to 2 times that of the area where the spanning member is welded to the holding member. After these various arrangements have been made, the primary skirt and the secondary skirt are magnetically coupled with the spanning member.

With this arrangement, the amount of mislandings caused by distorted electron beams occurring as a result of external magnetic fields such as terrestrial magnetism is lessened and the above-mentioned lateral corner properties and tube axial NS properties are improved. Furthermore, covering with the secondary skirt the area where the spanning member and the holding member are welded together leads to the alignment of the magnetic flux and to a decrease in electron beam mislandings that occur near the welded area. This makes it possible to decrease the amount of drifted or uneven color that occurs across the entire display screen.

In order that the inner magnetic shield in this design can be attached to the top of the holding members, it can be provided with a plurality of attachment surfaces at the extreme ends of its above-mentioned side bending edges. And at locations where these attachment surfaces are above the spanning members, it is possible for the above-mentioned primary skirt and secondary skirt to be formed by being extended from the side bending edges so that they reach the vicinity of a spanning member.

With this arrangement, it is desirable that the primary skirt that reaches down to the vicinity of the spanning member be designed so that its length as it runs in the direction of the length of the spanning member is ¼ to ⅓ that of the space between the holding members. This will result in a decrease in electron beam mislanding.

It is important to note here that the "magnetic coupling" mentioned above indicates a smooth connecting process. This results in magnetic flux at border areas of the various elements that produce no mislandings or fewer mislandings in comparison to prior art.

FIG, 2 show the main internal construction related to the inventiveness of the CRT of the first embodiment. It is an exploded perspective view of the inner magnetic shield attached to the mask frame.

Figure 3:
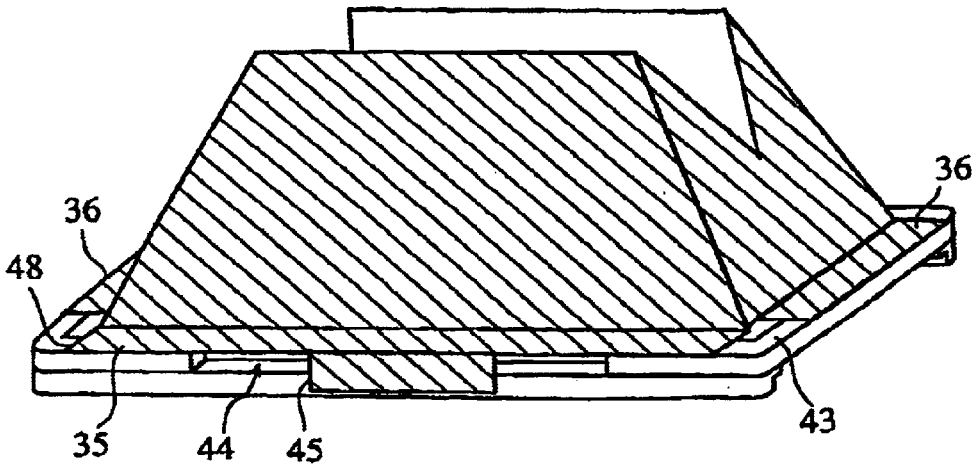

FIG. 3 is a perspective view showing the inner magnetic shield attached to the mask frame in the first embodiment.

Figure 4:
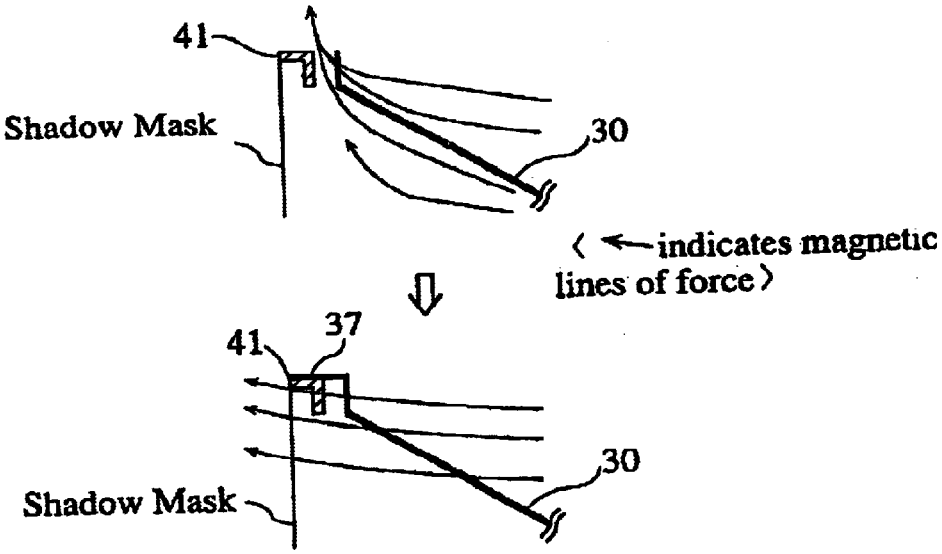

FIG. 4 is a conceptual drawing indicating the path of the magnetic flux at the boundary between the mask frame and the inner magnetic shield.

Figure 5:
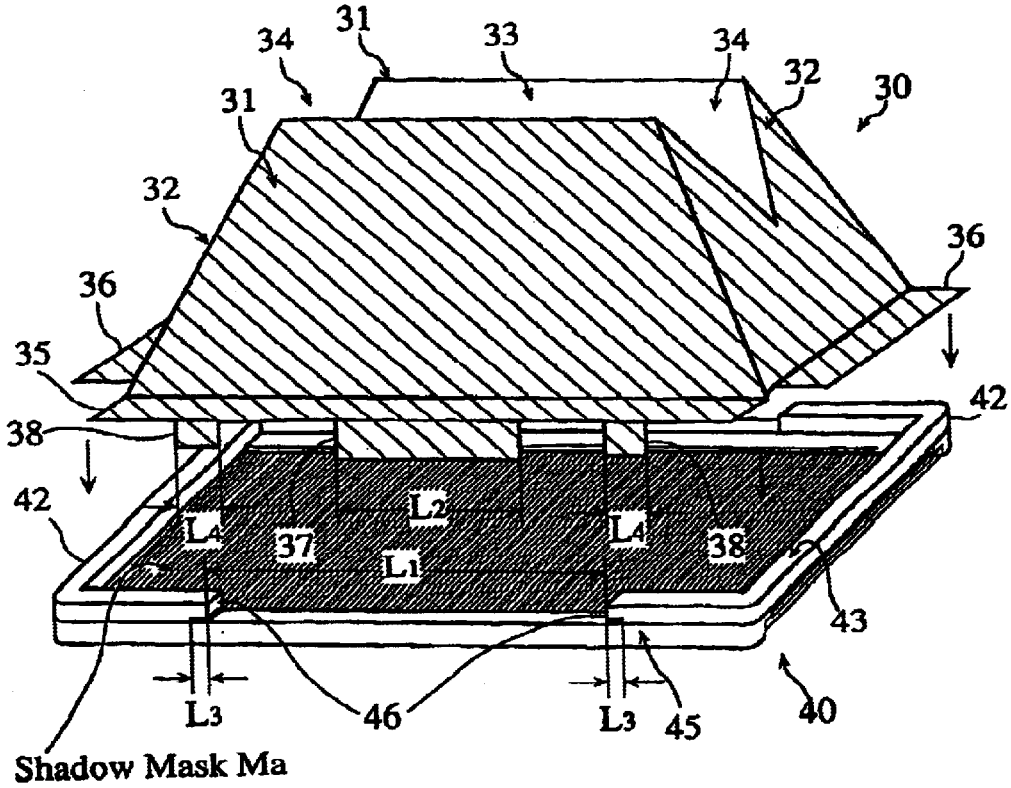

FIG. 5 shows the main internal construction related to the inventiveness of the CRT of the second embodiment. It is an exploded perspective view of the inner magnetic shield attached to the mask frame.

Figure 6:
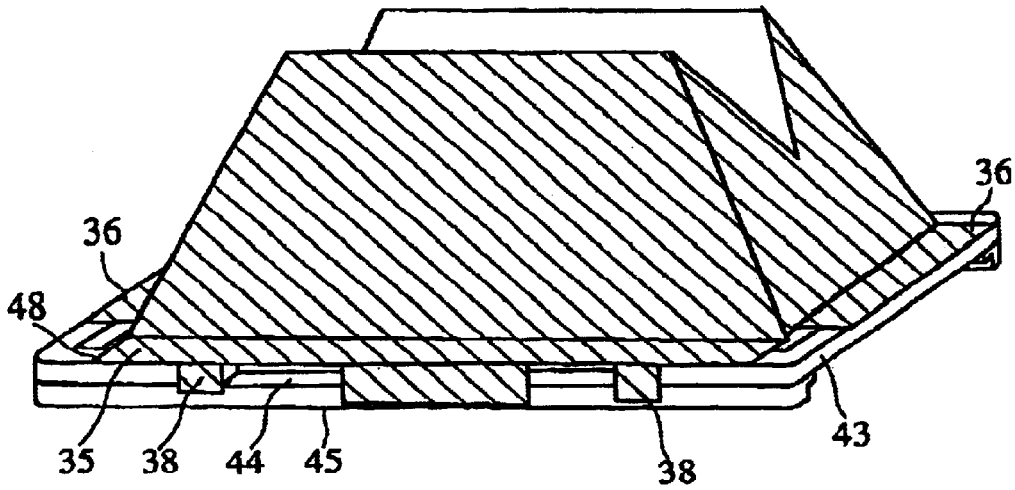

FIG. 6 is a perspective view showing the inner magnetic shield attached to the mask frame in the second embodiment.

Figure 7:
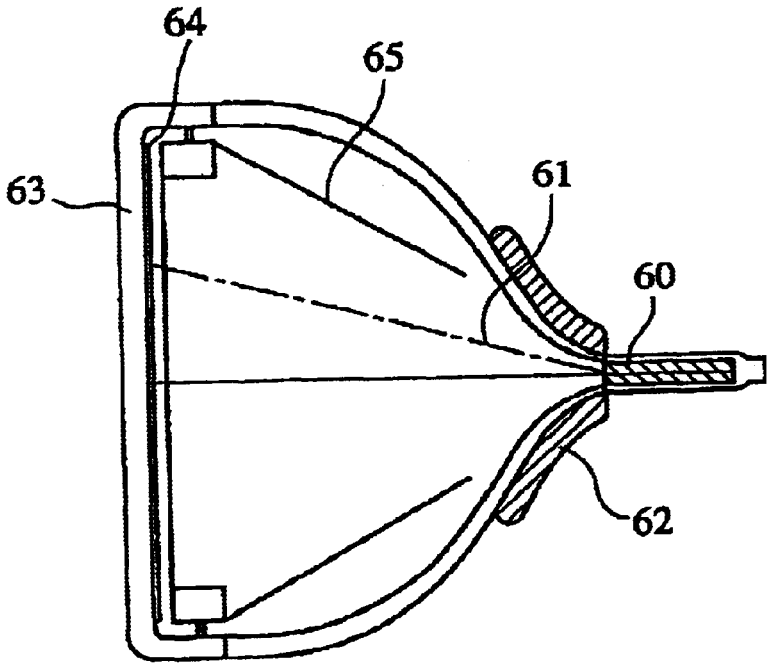

FIG. 7 is a sectional view of a conventional CRT.

Figure 8:
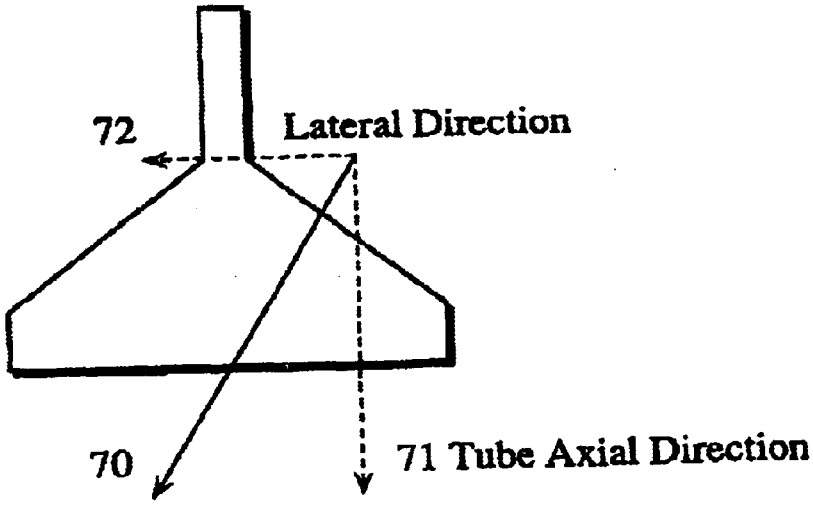

FIG 8 is a schematic drawing that shows the vector components of a horizontal magnetic field.

Figure 9:
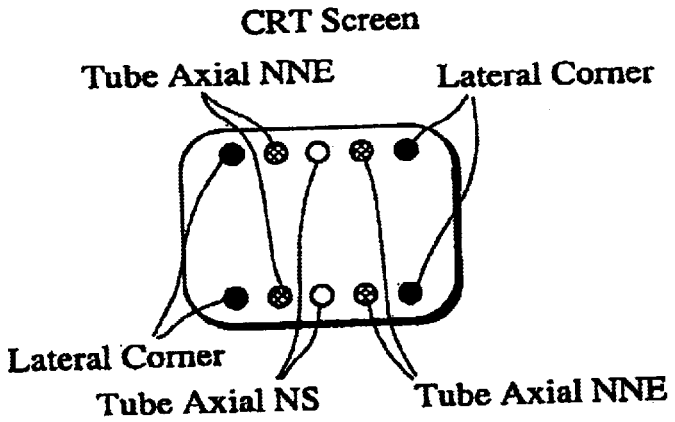

FIG. 9 indicates the locations where beam landings are measured.

Figure 10:
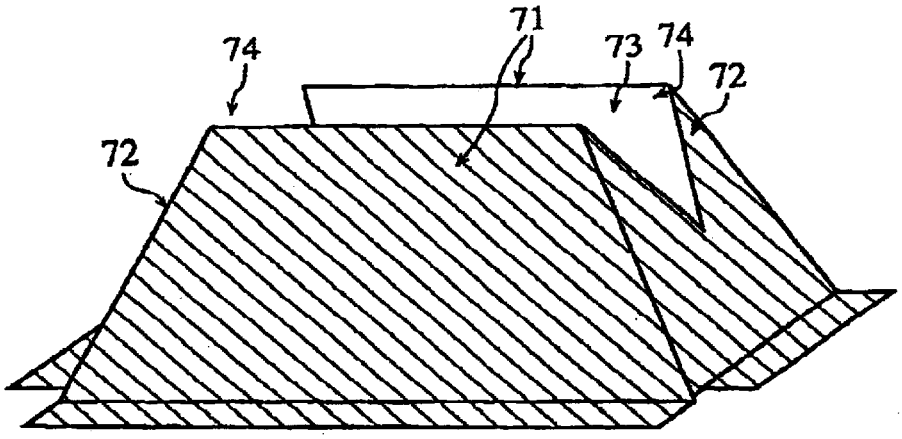

FIG. 10 is a perspective drawing or an inner magnetic shield of prior art.

Figure 11:
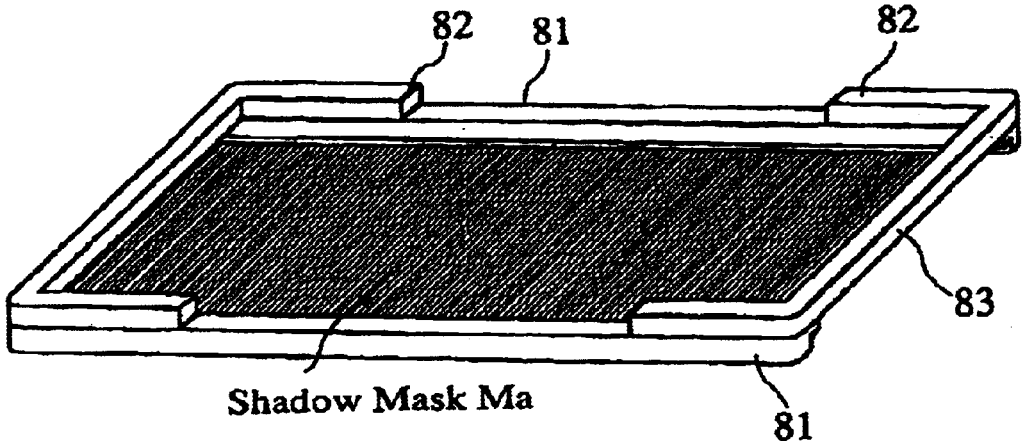

FIG. 11 is a perspective drawing of a mask frame of prior art.

PREFERRED EMBODIMENTS OF THE INVENTION

The following describes CRTs that are embodiments of the present invention, with reference to the attached figures.

The First Embodiment

Basic CRT Construction, Construction of Inner Magnetic Shield and Mask Frame

Figure 1:
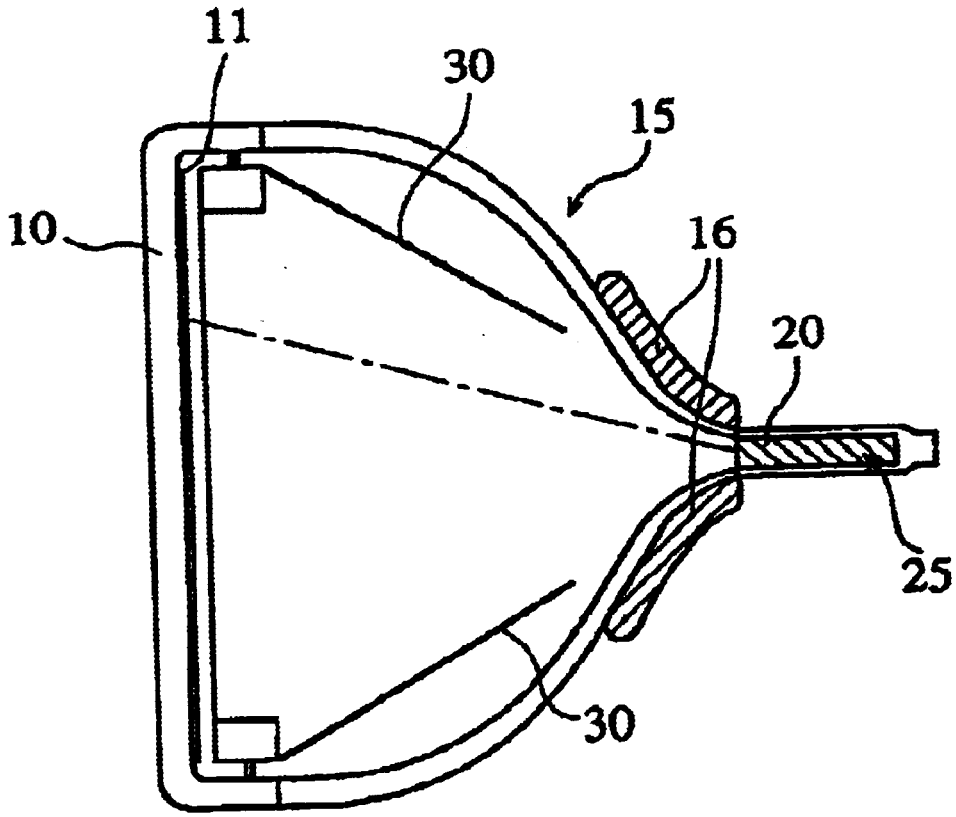
FIG. 1 is sectional view of a CRT in the first embodiment of the present invention.

FIG. 1 is a sectional view of a CRT in the first embodiment of the present invention. This is a 25-inch flat type CRT (the front surface of the face plate is flat) that has been in common use in recent years, and it contains a shadow mask to which tension is applied.

More specifically, the primary elements that comprise this CRT are a face plate 10 with a flat front surface, a funnel member 15 provided with an inner magnetic shield 30, a neck member 20, and an electron gun 25 inserted into the neck member 20.

Phosphor members 11 for multiple colors are formed on the inner surface of the face plate 10. Deflection coils 16 are wrapped entirely around the narrow end of the funnel member 15 located in the opposite direction to the face plate 10.

Figure 2:
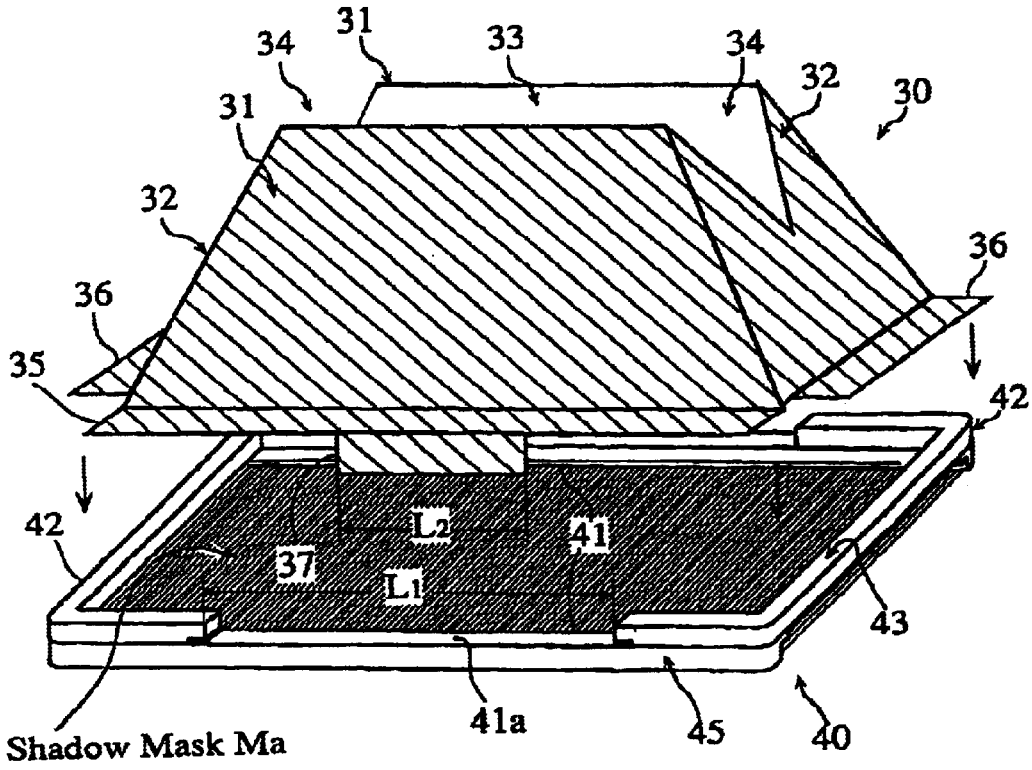

FIG. 2 shows the main internal construction related to the inventiveness of the CRT of the first embodiment. It is an exploded perspective view of the inner magnetic shield 30 attached to the mask frame 40.

As shown in FIG. 2, the inner magnetic shield 30 is a pyramid including two long sides 31 opposite to each other and two short sides 32 opposite to each other, where an opening 33 is formed at the top. A V-shaped cut 34 is formed in each short side 32 at an end near the opening at the deflection center.

Each bottom of the long sides 31 is outwardly bent to form a bending edge 35, and each bottom of the short sides 32 is outwardly bent to form a bending edge 36. Furthermore, there are primary skirts 37 (the skirt in the rear cannot be seen in the diagram) that are formed by extending downward (toward the CRT display screen) the central parts of the bending edge 35.

The mask frame 40 is composed of a pair of spanning members 41 (L-shaped in a sectional view) and a pair of U-shaped holding members 42. The pair of U-shaped holding members 42 are arranged opposite to each other. The pair of U-shaped holding members 42 are welded and fixed at two pairs of opposite ends of the pair of spanning members 41. A plurality of tensed wires are spanned between the pair of spanning members 41, the plurality of wires forming a shadow mask Ma. The plurality of wires are spanned at certain positions of the holding members 42 which are determined to hold the tension of the shadow mask Ma and to increase the strength of the frame in the direction of tension (note that this construction of the mask frame is the same as that of the conventional example, and that only the assigned numbers are different).

State of Attached Inner Magnetic Shield

FIG. 3 is a perspective view showing the inner magnetic shield attached to the mask frame. As indicated in this drawing, the bending edges 35 and 36 of the inner magnetic shield 30 are welded to the upper surface areas 43 of the U-shaped holding members 42.

The primary skirts 37 span the gaps 44 that are formed between the bending edges 35 and the spanning members 41, extending downward to be in contact with and welded to the outer surface 45 of the spanning members 41. The height and width of the gaps 44 can be regulated by varying the height (that is, the thickness) of the holding members 42 and by varying the distance between the two holding members 42. Note that it is acceptable for these primary skirts 37 to make contact with the upper surface 41*a* of the spanning members 41 rather than the outer surface 45.

Acts/Effects

As stated above, a gap 44 is formed between a bending edge 35 of the inner magnetic shield 30, a spanning member 41, and two holding members 42. If the primary skirt 37 is not included in this design, the magnetic properties become inconsistent and the path of the magnetic flux becomes considerably disarrayed. Essentially, without the primary skirt 37, the magnetic flux will overflow and spill out of the gap 44.

FIG. 4 is a schematic diagram showing the path of the magnetic flux at the boundary area between the mask frame and the inner magnetic shield. Note that in this diagram the magnetic field is produced from the rear end of the funnel moving in the direction of the face plate. That is, the funnel side is taken as being the N pole side and the face plate side is taken as being the S pole side.

As indicated in this diagram, the magnetic flux overflows and spills out of the gap causing the path of the magnetic flux to become considerably disarrayed. This results in an undesirable electric field being applied to the electron beam, further resulting in a comparatively large number of electron beam mislandings. In particular, this leads to an increased number of mislandings in the tube axial NS areas. This is due to the fact that the tube axial NS measurement points are located near the area of magnetic flux spillage.

Here, if the primary skirt 37 is provided so as to cover a portion of the gap 44 and if the inner magnetic shield 30 and the mask frame 40 are magnetically coupled, the magnetic spillage from the gap 44 is reduced. As a result, the magnetism flows to the shadow mask Ma, which is placed under tension on the front side of mask frame 40, and relatively smooth magnetic flux are formed that travel from the far side of the inner magnetic shield 30 to the mask frame 40. This smooth flow results in a minimal impact on the amount of mislandings produced.

Concretely speaking, the amount of mislandings produced when the primary skirt 37 was provided was:

(lateral corner property, tube axial NS property)=(12 $\mu$m, 16 $\mu$m).

It has been found that the acts and effects of smoothing down the magnetic flux depend on the ratio of the area of the primary skirt 37 to the area of the gap 44, especially they depend on L2 (length of the primary skirt 37): L1 (length of the gap 44) (for definition of the lengths, refer to FIG. 2).

Concretely speaking, experiments have proven that the best usage and effect are obtained when the length L2 of the primary skirt 37 is ¼ to ⅓ that of the length L1 of the gap 44. If the proportional relationship falls below the lower limit of ¼, there is hardly any benefit in adding the primary skirt 37. And if the proportional relationship exceeds the upper limit of ⅓, the smooth flow of the magnetic components that penetrate the inner magnetic shield 30 in the lateral direction is lost and the distribution of the magnetism becomes disarrayed.

In the manner stated above, it is possible to reduce the amount of electron beam mislandings occurring as a result of the overflow of magnetic flux. This is achieved by using a CRT of the first embodiment, which is provided with an inner magnetic shield 30 with primary skirts 37 magnetically coupled with the spanning members 41 of the mask frame 40. With this construction, it is possible to improve the picture quality of the display screen.

The Second Embodiment

The following is a description of the second embodiment of the present invention, with differences from the first embodiment being highlighted.

The inner magnetic shield 30 of the CRT of the second embodiment is basically the same as that mentioned above. However, it differs by having the special characteristics listed below.

As indicated in FIGS. 5 and 6 (FIG. 5 corresponding to FIG. 2, and FIG. 6 to FIG. 3), on both sides of the primary skirt 37, secondary skirts 38 (the rear side cannot be seen in the diagram) are added with a predetermined distance there between. The secondary skirts 38 extend downward (toward the CRT display screen) from the bending edges 35 in the same manner as the primary skirts 37, but covering spanning members 41 at welded areas 46 where the spanning members are welded together with the holding members 42. Then the secondary skirts 38 are welded to the outer surfaces 45 of the spanning members 41.

By providing the primary skirts 37 and secondary skirts 38, portions of the gaps 44 and the welded areas 46 are covered, stabilizing the path of the magnetic flux. This results in a decrease in the amount of electron beam mislandings, which occur to the extent that there is a disarray of the irradiation position of the beams.

Further, the magnetic properties change at the welded areas 46 due to the welding. This causes disarray in the magnetic flux in the vicinity of the areas, and this slight disarray also influences the irradiation position of the electron beams. However, by providing the secondary skirts 38 and by magnetically coupling the inner magnetic shield 30 with the mask frame 40, the disarray of the magnetic field near the welded areas 46 can be limited to an amount that minimally influences the amount of beam mislandings.

Concretely speaking, the amount of mislandings produced when the secondary skirts 38 were not provided was;

(lateral corner property, tube axial NS property, tube axial NNE property)=(12 $\mu$m, 16 $\mu$m, 20 $\mu$m).

Note that the tube axial NNF property is that which is measured at the points located between the tube axial NS property measurement points and the lateral property measurement points. This tube axial NNE property is a property that results when a magnetic field is applied in the tube axial direction.

The amount of mislandings produced when the secondary skirts 38 were provided was:

(lateral corner property, tube axial NS property, tube axial NNE property)=(13 $\mu$m, 15 $\mu$m, 16 $\mu$m).

This indicates an effectiveness in reducing the amount of mislandings, and, above all, it indicates an improvement in the magnetic properties at the tube axial NNE locations.

The acts and effects of reducing the amount of mislandings (the acts and effects of smoothing down the magnetic flux) depend on L4 (length of the secondary skirt 38 covering the welded area 46): L3 (length of the welded area 46 along the spanning member 41) (for the definition of the lengths, refer to FIG. 5).

Concretely speaking, it has been proven through experimentation that the length L4 of the secondary skirts 38 should be 1 to 2 times the length of the welded areas 46.

If the area of a secondary skirt 38 covering a welded area 46 is to be expanded, it should be done by extending the secondary skirt 38 toward the end of the spanning member 41. This is because if extension does not take place in this direction, the gap between the secondary skirts 38 and the primary skirts 37 will become smaller. This will produce the same results as the case mentioned for the first embodiment wherein the maximum length of the primary skirt 37 was exceeded, resulting in an inability to maintain a smooth flow of the magnetic components that penetrate the inner magnetic shield 30 from a lateral direction.

By using an inner magnetic shield with skirts like those mentioned above that are magnetically coupled with holding members, it is possible to reduce and nullify the impact of external magnetic forces, such as terrestrial magnetism, on the path of the electron beam as it travels to the phosphor surface of the face plate. This results in a reduction in the amount of mislandings caused by distortion of the beam, which prevents the occurrence of drifted or uneven color over the entire display screen.

Note that although the above embodiments assume a 25-inch CRT, it is possible to apply the described characteristics to CRTs of different sizes. In such cases, the required sizes for the primary skirts and the secondary skirts would be different. Additionally, it is possible to develop 2 additional designs by including notches within the primary skirts and the secondary skirts.

Furthermore, it is possible for the holding members to be joined together with the spanning members by screws or other non-welding means. In such cases, changes in magnetic properties will still occur at the joined areas, so it is still effective to provide secondary skirts.

Note that the above-mentioned embodiments do not require a plurality of primary skirts or a plurality of secondary skirts. Rather, in each case they call for at least one of the particular skirts being described. Even if only one of a particular skirts is provided, such a design is more effective than one in which skirts are absent, and, therefore, such a design is considered to be within the scope of this invention. Additionally, a design in which the skirts are not in actual physical contact with a spanning member is considered to be within the scope of the invention as long as the acts and effects similar to that of the above embodiments can be achieved.

Additionally, the shadow masks of the embodiments of the present invention were described as having tension applied. However, one should note here that while tension-type shadow masks allow the present invention to be particularly effective, they are not required in the design.

In the above manner, the cathode ray tube of the present invention simultaneously reduces, to a remarkable degree, the amount of beam mislandings that occur at the lateral corner, the tube axial NS, and the tube axial NNE locations due to external magnetic forces equivalent to terrestrial magnetism. It achieves this by being provided with a mask frame that is magnetically coupled with at least one primary skirt and at least one secondary skirt extended from an inner magnetic shield down over the mask frame. That is, by using an inner magnetic shield such as that described above, it is possible to minimize and nullify the impact of terrestrial magnetism and other external forces on the path of the electron beam as it travels to the phosphor surface. This results in a reduction in the amount of mislandings caused by distortion of the electron beam, which prevents the occurrence of drifted or uneven color over the entire display screen.

Industrial Applicability

The present invention can be used as a CRT that produces high picture quality as a result of improved magnetic properties brought about by the shapes and form of a mask frame and an inner magnetic being joined together, designed to reduce negative effects caused by terrestrial magnetism.

What is claimed is:

1. A cathode ray tube comprising:

an inner magnetic shield, a mask frame, a shadow mask, and a face plate, wherein the mask frame is made up of a) a pair of attachment members to which the shadow mask in attached, and b) a pair of positioning members that are joined with the attachment members to keep them in a predetermined position, the inner magnetic shield a) is mounted onto the positioning members, b) is a tube with a plurality of side surfaces, and c) is provided with one or more skirts that, at locations where the inner magnetic shield is not in contact with the positioning members, extend to vicinities of the attachment members, and the one or more skirts are magnetically coupled with the attachment members.

2. The cathode ray tube of claim 1 or claim 1, wherein a length of the one or more skirts in a direction of a length of the attachment members or spanning members is set so that all magnetic flux produced from an external magnetic field flows from the inner magnetic shield to the mask frame.

3. The cathode ray tube of claim 2, wherein the inner magnetic shield is provided with a plurality of mounting surface members at ends of its side surfaces, and the one or more skirts are formed as extensions from central portions of mounting surface members that run in the direction of the length of the attachment members or spanning members.

4. The cathode ray tube of claim 2, wherein a length of the one or more skirts in the direction of the length of the attachment members or spanning members is no smaller than ¼ and no greater than ⅓ that of a distance between directly opposing ends of the positioning members or holding members.

5. The cathode ray tube of claim 1 or claim 2, wherein the inner magnetic shield is provided with a plurality of mounting surface members at ends of its side surfaces, and the one or more skirts are formed as extensions from central portions of mounting surface members that run in the direction of the length of the attachment members or spanning members.

6. The cathode ray tube of claim 5, wherein a length of the one or more skirts in the direction of the length of the attachment members or spanning members is no smaller than ¼ and no greater than ⅓ that of a distance between directly opposing ends of the positioning members or holding members.

7. The cathode ray tube of claim 1 or claim 2, wherein a length of the one or more skirts in the direction of the length of the attachment members or spanning members is no smaller than ¼ and no greater than ⅓ that of a distance between directly opposing ends of the positioning members or holding members.

8. A cathode ray tube comprising:

an inner magnetic shield, a mask frame, a shadow mask, and a face plate, wherein the mask frame is made up of a) a pair of spanning members to which the shadow mask is attached in a state of tension, and b) a pair of holding members that are joined with the spanning members and maintain the shadow mask tension by being arranged in a position that Is parallel to a direction of tension, the inner magnetic shield a) is mounted onto the holding members, b) is a tube with a plurality of side surfaces, and c) is provided with one or more skirts that, at locations where the inner magnetic shield is not in contact with the holding members, extend to vicinities of the spanning members, and the one or more skirts are magnetically coupled with the spanning members.

9. The cathode ray tube of claim 8, wherein a length of the one or more skirts in a direction of a length of the attachment members or spanning members is set so that all magnetic flux produced from an external magnetic field flows from the inner magnetic shield to the mask frame.

10. A cathode ray tube comprising:

an inner magnetic shield, a mask frame, a shadow mask, and a face plate, wherein the mask frame is made up of a) a pair of attachment members to which the shadow mask is attached, and b) a pair of positioning members that are joined with the attachment members to keep them in a predetermined position, the inner magnetic shield a) is mounted onto the positioning members, b) is a tube with a plurality of side surfaces, and c) is provided with one or more primary skirts and one or more secondary skirts, wherein at locations where the inner magnetic shield is not in contact with the positioning members, the one or more primary skirts extend to vicinities of the attachment members, the one or more secondary skirts extend over an outer surface of the mask frame to cover tie attachment members at areas where they are joined to the positioning members, a length of the one or more secondary skirts in a direction of a length of the attachment members is no smaller than 1 and no greater than 2 times that of the areas where the attachment members are joined to the positioning members, and the one or more primary skirts and the one or more secondary skirts are magnetically coupled with the attachment members.

11. The cathode ray tube of claim 10, wherein the inner magnetic shield is provided with a plurality of mounting surface members at ends of its side surfaces that, the one or more primary skirts are formed as extensions from central portions of mounting surface members that run in the direction of the length of the attachment members or spanning members, and at locations on both sides of the one or more primary skirts, the one or more secondary skirts are also formed as extensions from the mounting surface members.

12. The cathode ray tube of claim 11, wherein a length of the one or more primary skirts in the direction of the length of the attachment members or spanning members is no smaller than ¼ and no greater than ⅓ that of a distance between directly opposing ends of the positioning members or holding members.

13. The cathode ray tube of claim 10, wherein a length of the one or more primary skirts in a direction of a length of the attachment members or spanning members is no small than ¼ and no greater than ⅓ that of a distance between directly opposing ends of the positioning members of holding members.

14. A cathode ray tube comprising:

an inner magnetic shield, a mask frame, a shadow mask, and a face plate, wherein the mask frame is made up of a) a pair or spanning members to which the shadow mask is attached in a state of tension, and b) a pair of holding members that are joined with the spanning members and maintain the shadow mask tension by being arranged in a position that is parallel to a direction of tension, the inner magnetic shield axis mounted onto the holding members, b) is a tube with a plurality of side surfaces, and c) is provided with one or more primary skirts and one or more secondary skirts, wherein at locations where the inner magnetic shield is not in contact with the holding members, the one or more primary skirts extend to vicinities of the spanning members, the one or more secondary skirts extend over an outer surface of the mask frame to cover the spanning members at areas where they are joined to the holding members, a length of the one or more secondary skirts in a direction of a length of the spanning members is no smaller than 1 and no greater than 2 times that of the areas where the spanning members are joined to the holding members, and the one or more primary skirts and the one or more secondary skirts are magnetically coupled with the spanning members.

15. The cathode ray tube of claim 14, wherein the inner magnetic shield is provided with a plurality of mounting surface members at ends of its side surfaces that, the one or more primary skirts are formed as extensions from central portions of mounting surface members that run in the direction of the length of the attachment members or spanning members, and at locations on both sides of the one or more primary skirts, the one or more secondary skirts are also formed as extensions from the mounting surface members.

16. The cathode ray tube of claim 14, wherein a length of the one or more primary skirts in a direction of a length of the attachment members or spanning members is no small than ¼ and no greater than ⅓ that of a distance between directly opposing ends of the positioning members of holding members.

* * * * *